US011085241B2

(12) United States Patent
Randle et al.

(10) Patent No.: US 11,085,241 B2
(45) **Date of Patent: *Aug. 10, 2021**

(54) ADJUSTABLE SPLIT THRUST RING

(71) Applicant: Halliburton Energy Services, Inc., Houston, TX (US)

(72) Inventors: Hartley Randle, Spruce Grove (CA); Brandon Jullion, Edmonton (CA); Gustav Edward Lange, Millet (CA); Alben D'Silva, Edmonton (CA); Kennedy John Kirkhope, Leduc (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/477,688

(22) PCT Filed: Mar. 9, 2017

(86) PCT No.: PCT/US2017/021622
§ 371 (c)(1),
(2) Date: Jul. 12, 2019

(87) PCT Pub. No.: WO2018/164687
PCT Pub. Date: Sep. 13, 2018

(65) Prior Publication Data

US 2019/0360277 A1 Nov. 28, 2019

(51) Int. Cl.
*E21B 4/00* (2006.01)
*E21B 7/06* (2006.01)
(Continued)

(52) U.S. Cl.
CPC ..... *E21B 4/003* (2013.01); *E21B 7/062* (2013.01); *E21B 10/22* (2013.01); *E21B 12/00* (2013.01)

(58) Field of Classification Search
CPC ..... E21B 4/003; E21B 10/22
See application file for complete search history.

(56) References Cited

U.S. PATENT DOCUMENTS 4,240,683 A 12/1980 Crase
4,560,014 A * 12/1985 Geczy ..... E21B 4/00 175/107

(Continued)

FOREIGN PATENT DOCUMENTS

JP 2009243572 A 10/2009
WO 2018164687 A1 9/2018

*Primary Examiner* — Tara Schimpf
(74) *Attorney, Agent, or Firm* — Benjamin Ford; Parker Justiss, P.C.

(57) ABSTRACT

Provided is an adjustable split thrust ring and a drilling system including the same. The adjustable split thrust ring, in one embodiment, includes a downhole split ring including two or more separate downhole pieces, the two or more separate downhole pieces fitting together to form a substantially circular downhole shoulder surrounding a substantially circular driveshaft. The adjustable split thrust ring further includes an uphole split ring positionable proximate the downhole split ring and including two or more separate uphole pieces, the two or more separate uphole pieces fitting together to form a substantially circular uphole shoulder surrounding the substantially circular driveshaft. In this embodiment, the substantially circular downhole shoulder and the substantially circular uphole shoulder are movable relative to one another to adjust to fit a groove in a driveshaft that they are configured to sit.

18 Claims, 17 Drawing Sheets

(51) Int. Cl.
*E21B 12/00* (2006.01)
*E21B 10/22* (2006.01)

(56) References Cited

U.S. PATENT DOCUMENTS

| | | | | |
|---|---|---|---|---|
| 2010/0122849 | A1* | 5/2010 | Salzer, III | E21B 17/1064 175/57 |
| 2012/0114274 | A1 | 5/2012 | Peasy | |
| 2012/0195542 | A1 | 8/2012 | Marchand | |
| 2012/0285748 | A1* | 11/2012 | Kirkhope | F16C 19/26 175/371 |
| 2016/0032962 | A1 | 2/2016 | Kirkhope | |

* cited by examiner

ADJUSTABLE SPLIT THRUST RING

CROSS-REFERENCE TO RELATED APPLICATION

This application is the National Stage of, and therefore claims the benefit of, International Application No. PCT/US2017/021622 filed on Mar. 9, 2017, entitled "ADJUSTABLE SPLIT THRUST RING," which was published in English under International Publication Number WO 2018/164687 on Sep. 13, 2018. The above application is commonly assigned with this National Stage application and is incorporated herein by reference in its entirety.

BACKGROUND

In the oil and gas industry, rotary steerable tools for downhole operations can be used to drill into a formation along a desired path that can change in direction as the tool advances into the formation. Such tools can employ components that brace against the formation to provide a reaction torque to prevent rotation of non-rotating tool portions used as a geostationary reference in steering the rotating portions of the tool.

Such conventional methods and systems have generally been considered satisfactory for their intended purpose. However, there is still a need in the art for improved steerable rotary tools, and components for use therewith. The present disclosure provides a solution for this need.

BRIEF DESCRIPTION

Reference is now made to the following descriptions taken in conjunction with the accompanying drawings, in which:

FIG. 2 illustrates a cross-sectional view of the housing and driveshaft of FIG. 1, with an adjustable split thrust ring positioned there between;

DETAILED DESCRIPTION

Many oil/gas drilling systems require a non-rotating outer housing as a geostationary reference to maintain steering control while drilling. Such downhole drilling systems often employ a thrust ring positioned between the driveshaft (e.g. proximate the drillbit) and the housing to transfer axial loads between the two as the downhole drilling system is tripping into and out of the wellbore.

With the aforementioned in mind, the present disclosure has acknowledged the importance of the fit between the driveshaft and the thrust ring. Specifically, the present disclosure has acknowledged the importance of the fit between the inner shoulder of the thrust ring and an associated groove in the outer surface of the driveshaft. Moreover, the present disclosure has acknowledged that the general fit between the inner shoulder of the thrust ring and the associated groove in the outer surface of the driveshaft tends to change over time.

With the foregoing acknowledgments in mind, the present disclosure recognized that an adjustable split thrust ring could be designed to account for the changes in fit (e.g., over time) that may occur between the thrust ring and the associated groove in the outer surface of the driveshaft. The present disclosure further recognized that an adjustable split thrust ring could be designed such that a substantially circular downhole shoulder thereof and a substantially circular uphole shoulder thereof could move relative to one another to adjust to fit any changes in the fit with the groove. Specifically, an adjustable split thrust ring could be designed such that the substantially circular downhole shoulder and substantially circular uphole shoulder could move axially relative to one another to adjust to fit any changes in the fit with the groove.

Figure 1:
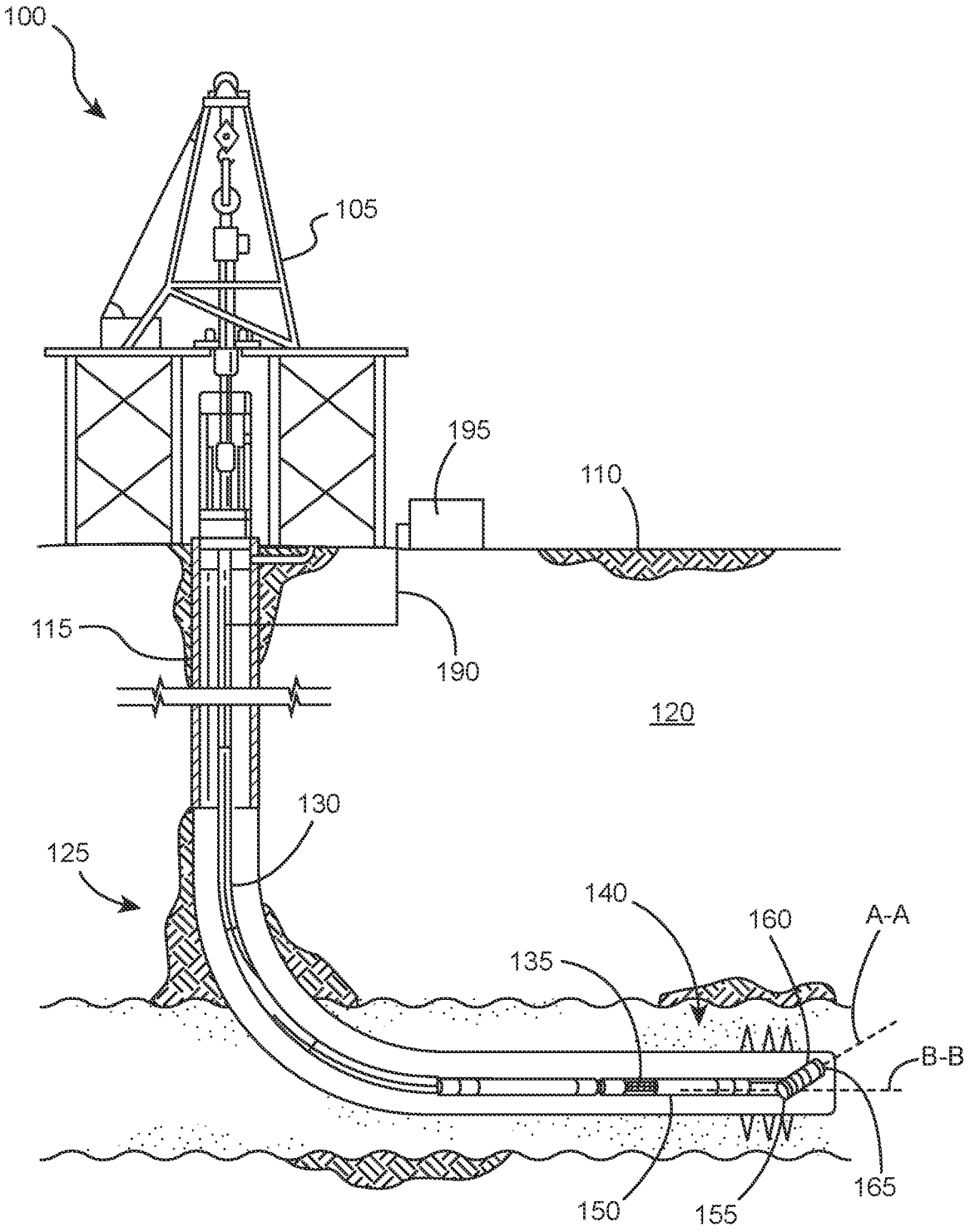
FIG. 1 illustrates a sectional view of an example drilling system according to aspects of the present disclosure.

Reference will now be made to the drawings wherein like reference numerals identify similar structural features or aspects of the subject disclosure. For purposes of explanation and illustration, and not limitation, FIG. 1 illustrates a sectional view of an example drilling system 100 according to aspects of the present disclosure. The drilling system 100 includes a rig 105 mounted at the surface 110 and positioned above wellbore 115 within a subterranean formation 120. In the embodiment shown, a drilling assembly 125 may be positioned within the wellbore 115 and may be coupled to the rig 105. The drilling assembly 125 may comprise drillstring 130 and anti-rotation system 135, among other items. The drillstring 130 may comprise a plurality of segments threadedly connected to one another.

The drilling assembly 125 may further include a bottom hole assembly (BHA) 140. The BHA 140 may comprise a steering assembly, with a housing 150, an internal driveshaft 155 and a drill bit 160 coupled to a lower end of the BHA 140. The steering assembly may control the direction in which the wellbore 115 is being drilled. The wellbore 115 will typically be drilled in the direction relative to a tool face 165 of the drill bit 160, which corresponds to the longitudinal axis A-A of the drill bit 160. Accordingly, controlling the direction in which the wellbore 115 is drilled may include controlling the angle of the longitudinal axis A-A of the drill bit 160 relative to the longitudinal axis B-B of the housing 150, and controlling the angular orientation of the drill bit 160 with respect to the steering assembly. Furthermore, the anti-rotation system 135 provides a geostationary reference point for the steering assembly.

The drilling system 100 may additionally include any suitable wired drillpipe, coiled tubing (wired and unwired), e.g., accommodating a wireline 190 for control of the steering assembly (e.g., including the BHA 140) from the surface 110 during downhole operation. It is also contemplated that the drilling system 100 as described herein can be used in conjunction with a measurement-while-drilling (MWD) apparatus, which may be incorporated into the drillstring 130 for insertion in the wellbore 115 as part of a MWD system. In a MWD system, sensors associated with the MWD apparatus provide data to the MWD apparatus for communicating up the drillstring 130 to an operator of the drilling system 100. These sensors typically provide directional information of the drillstring 130 so that the operator can monitor the orientation of the drillstring 130 in response to data received from the MWD apparatus and adjust the orientation of the drillstring 130 in response to such data. An MWD system also typically enables the communication of data from the operator of the system down the wellbore 115 to the MWD apparatus. Systems and methods as disclosed herein can also be used in conjunction with logging-while-drilling (LWD) systems, which log data from sensors similar to those used in MWD systems as described herein. In FIG. 1, the MWD/LWD system 195 is shown connected to drillstring 130 by wireline 190.

In operation, the drilling assembly 125 may be advanced downhole through the wellbore 115 in the formation 120. In accordance with the disclosure, as the drilling assembly 125 trips into and out of the wellbore 115, an adjustable split thrust ring (e.g., not shown in FIG. 1) positioned between the housing 150 and the driveshaft 155 transfers an axial load between the two. The adjustable split thrust ring, in one embodiment consistent with the disclosure, employs an adjustable substantially circular downhole shoulder and substantially circular uphole shoulder to adjust to fit a groove in the driveshaft 155.

Figure 2:
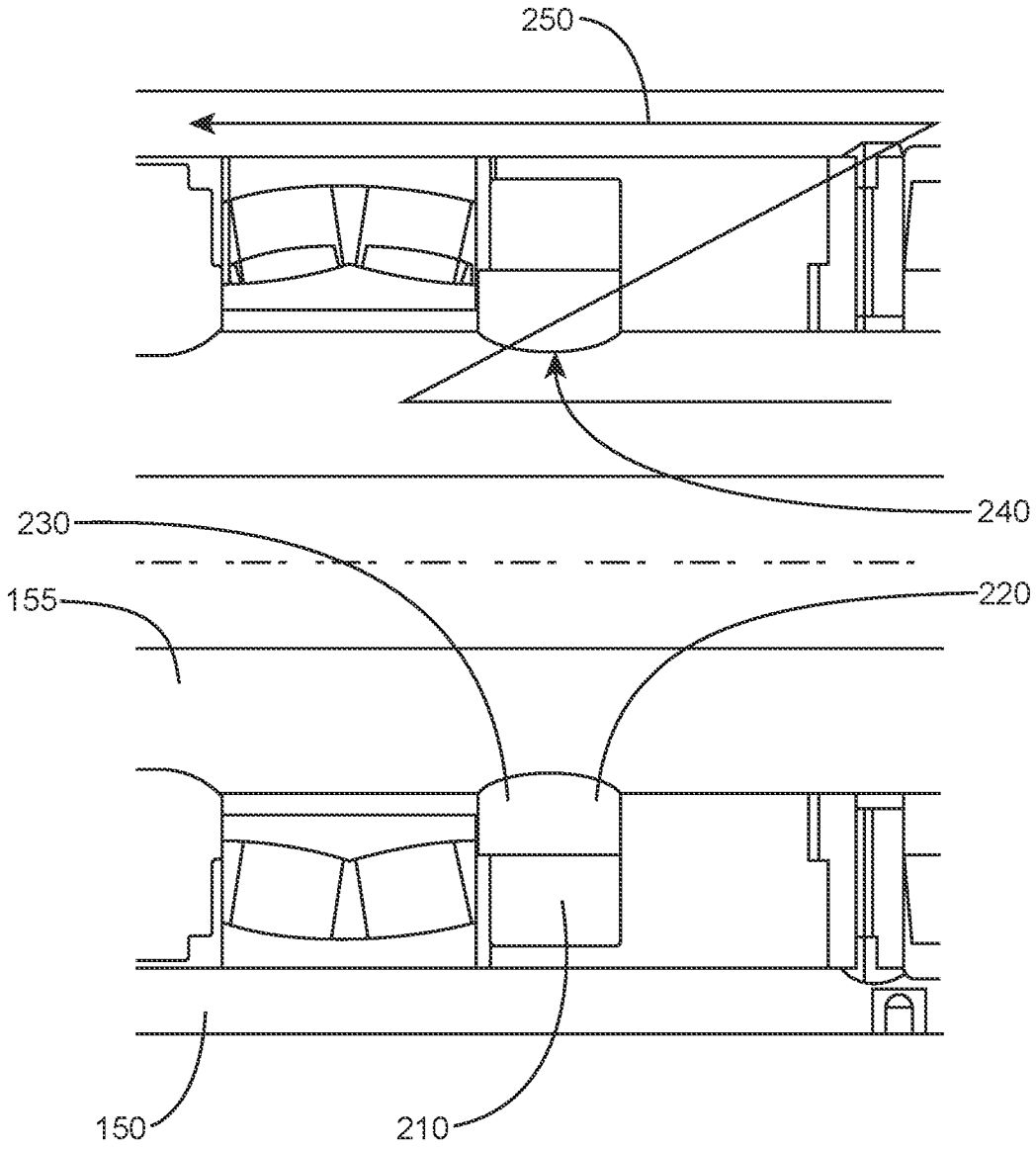

Turning briefly to FIG. 2, illustrated is a cross-sectional view of the housing 150, driveshaft 155 and an adjustable split thrust ring 210 positioned there between. The adjustable split thrust ring 210, in this embodiment, is configured to transfer an axial load 250 between the driveshaft 155 and the housing 150. In the embodiment of FIG. 2, the adjustable split thrust ring 210 includes a substantially circular downhole shoulder 220, which those skilled in the art understand will be positioned on the downhole side of the drilling system 100, and a substantially circular uphole shoulder 230, which those skilled in the art understand will be positioned on the uphole side of the drilling system 100. The phrase "substantially circular" as used herein means that the shoulders 220, 230 of the adjustable split thrust ring 210 are generally in the shape of a circle. The substantially circular downhole and uphole shoulders 220, 230, need not be perfect circles to remain within the scope of the present disclosure, and among others may be slightly oval, lobed shaped, or other similar shapes.

In the embodiment illustrated in FIG. 2, the adjustable split thrust ring 210 fits within a groove 240 in the driveshaft 155. As shown in the embodiment of FIG. 2, the groove 240 may surround a circumference of the driveshaft 155. In accordance with the disclosure, the substantially circular downhole shoulder 220 and the substantially circular uphole shoulder 230 are configured to move (e.g., axially in one embodiment) relative to one another to adjust for changes in a shape of the groove 240.

Figure 3A:
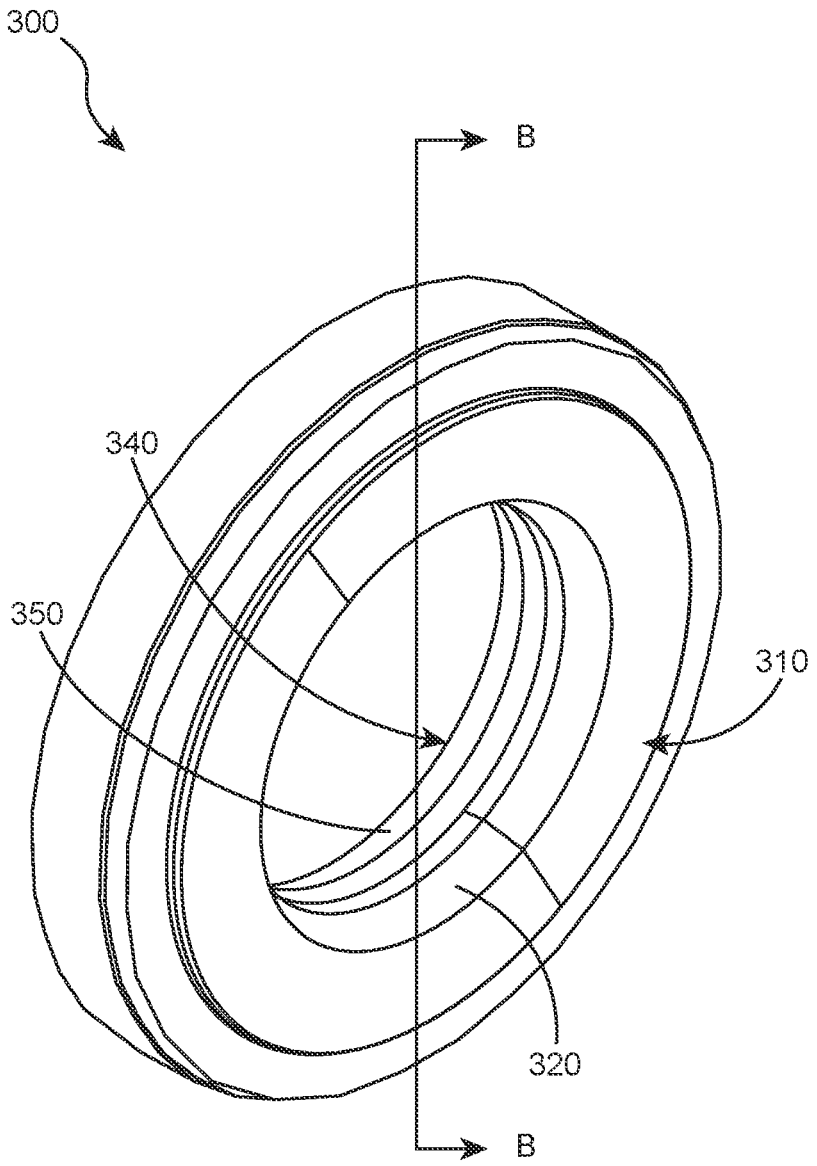
FIGS. 3A through 3C illustrate one embodiment of an adjustable split thrust ring manufactured in accordance with the disclosure.

Turning to FIG. 3A, illustrated is a perspective view of one embodiment of an adjustable split thrust ring 300 manufactured in accordance with the disclosure. As can be seen in FIG. 3A, the adjustable split thrust ring 300 includes a downhole split ring 310 comprising two or more separate downhole pieces configured to fit together to form a substantially circular downhole shoulder 320. As can further be seen in FIG. 3A, the adjustable split thrust ring 300 includes an uphole split ring 340 positioned proximate the downhole split ring 310 and comprising two or more separate uphole pieces, the two or more separate uphole pieces configured to fit together to form a substantially circular uphole shoulder 350.

Figure 3B:
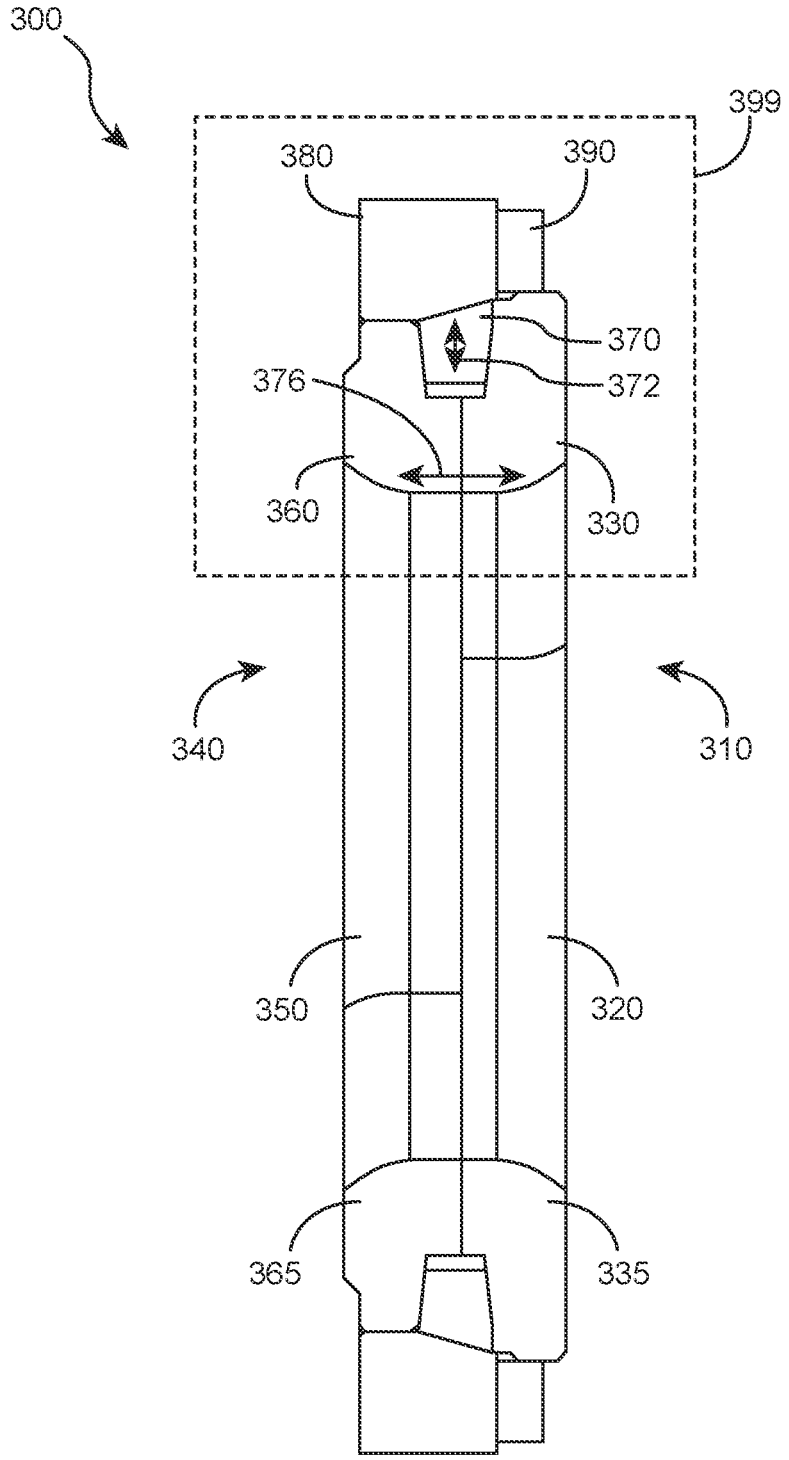

Turning now to FIG. 3B, illustrated is a cross-sectional view of the adjustable split thrust ring 300 illustrated in FIG. 3A taken through the line B-B. As can be seen in FIG. 3B, the adjustable split thrust ring 300 includes the downhole split ring 310 including two separate downhole pieces 330, 335 configured to fit together to form the substantially circular downhole shoulder 320. As can further be seen in FIG. 3B, the adjustable split thrust ring 300 includes the uphole split ring 340 positioned proximate the downhole split ring 310 and including two separate uphole pieces 360, 365, the two separate uphole pieces 360, 365 configured to fit together to form the substantially circular uphole shoulder 350.

As shown in the embodiment of FIG. 3B, the adjustable split thrust ring 300 further includes one or more wedges 370 positioned between associated ones of the two separate downhole pieces 330, 335 and the two separate uphole pieces 360, 365. The wedge 370, in the embodiment of FIG. 3B, is configured to travel radially (e.g., as shown by the arrow 372) to move the substantially circular downhole shoulder 320 and the substantially circular uphole shoulder 350 relative to one another. In the illustrated embodiment, the wedge 370 is configured to travel radially inward to move the substantially circular downhole shoulder 320 and the substantially circular uphole shoulder 350 axially (e.g., as shown by the arrow 376) outward relative to one another.

The adjustable split thrust ring 300 of FIG. 3B additionally includes a tapered lock ring 380 at least partially surrounding the two separate downhole pieces 330, 335 or the two separate uphole pieces 360, 365 and engaging the wedge 370. In the embodiment of FIG. 3B, the tapered lock ring 380 substantially surrounds the two separate uphole pieces 360, 365. In the embodiment of FIG. 3B, the tapered lock ring 380 is configured to move axially (e.g., in a direction similar to that shown by the arrow 376) and thereby cause the wedge 370 to travel radially inward. In this embodiment, as the wedge 370 travels radially inward, it causes the substantially circular downhole shoulder 320 and the substantially circular uphole shoulder 350 to move radially outward relative to one another to adjust to fit a groove in a driveshaft.

The adjustable split thrust ring 300 of FIG. 3B additionally includes a lock ring 390 configured to at least partially surround the other of the two separate downhole pieces 330, 335 or the two separate uphole pieces 360, 365. In the particular embodiment of FIG. 3B, the lock ring 390 at least partially surrounds the two separate downhole pieces 330, 335. The lock ring 390, as is illustrated, may be configured to abut up next to the tapered lock ring 380 and thereby prevent the tapered lock ring 380 from unintended movement based upon vibrations in the adjustable split thrust ring 300.

Figure 3C:
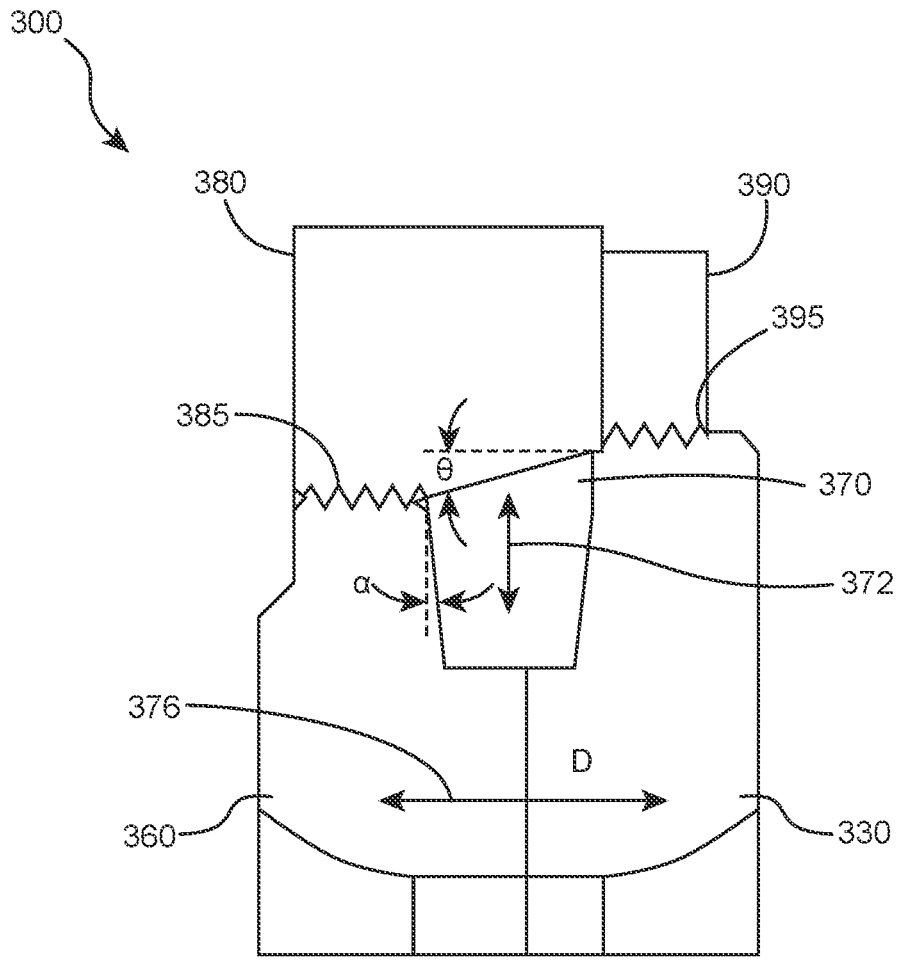

Turning to FIG. 3C, illustrated is a zoomed in portion of the adjustable split thrust ring 300 of FIG. 3B as denoted by the dashed box 399. As illustrated in FIG. 3C, the tapered lock ring 380 and the two separate uphole pieces 360, 365 include corresponding tapered lock ring threads 385. The tapered lock ring threads 385 allow the tapered lock ring 380 and the two separate uphole pieces 360, 365 to spin relative to one another to move the tapered lock ring 380 axially and thereby cause the wedge 370 to travel radially inward. Similarly, the lock ring 390 and the two separate downhole pieces 330, 335 have corresponding lock ring threads 395. The lock ring threads 395 allow the lock ring 390 and the two separate downhole pieces 330, 335 to spin relative to one another to cause the lock ring 390 to abut up next to the tapered lock ring 380.

The wedge 370 may be manufactured in many different ways to achieve the purposes of the present disclosure. In one embodiment, the wedge 370 has an angle ($\alpha$) that is small enough to allow fine adjustments to the relative axial movement of the substantially circular downhole shoulder 320 and substantially circular uphole should 350 with the radial movement of the wedge 370. In one embodiment, the angle (α) is less than about 30 degrees, yet in other embodiments the angle (α) is less than about 15 degrees, and even yet other embodiments (e.g., wherein extremely fine adjustment is required) less than about 10 degrees.

The wedge 370 may also have an angle (θ) that is small enough to allow for the fine adjustments to the relative axial movement of the substantially circular downhole shoulder 320 and substantially circular uphole should 350 with the radial movement of the wedge 370. In one embodiment, the angle (θ) is less than about 45 degrees, yet in other embodiments the angle (θ) is less than about 30 degrees, and even yet other embodiments (e.g., wherein the extremely fine adjustment is required) less than about 20 degrees. While various different angles may be referenced throughout the disclosure, unless noted otherwise, they represent an example orientation, and the present disclosure should not be limited to such angles.

An adjustable split thrust ring manufactured in accordance with the present disclosure, such as the adjustable split thrust ring 300, may adjust the substantially circular downhole shoulder 320 and the substantially circular uphole shoulder 350 axially by a distance D up to about 30 mm. In yet another embodiment, the distance D may only be up to about 7.5 mm. These distances D allow the adjustable split thrust ring to accommodate many different driveshaft groove sizes, as well as allows the adjustable split thrust ring to accommodate use-based changes in the size of the driveshaft groove.

The adjustable split thrust ring 300 illustrated in FIGS. 3A through 3C employs only two separate downhole pieces 330, 335 and two separate uphole pieces 360, 365. Those skilled in the art appreciate that more than two separate downhole pieces and uphole pieces are within the purview of the present disclosure. In fact, various embodiments may be employed wherein four or more separate downhole pieces and four or more uphole pieces are used. Similar numbers may be used for the wedge 370.

Figure 4A:
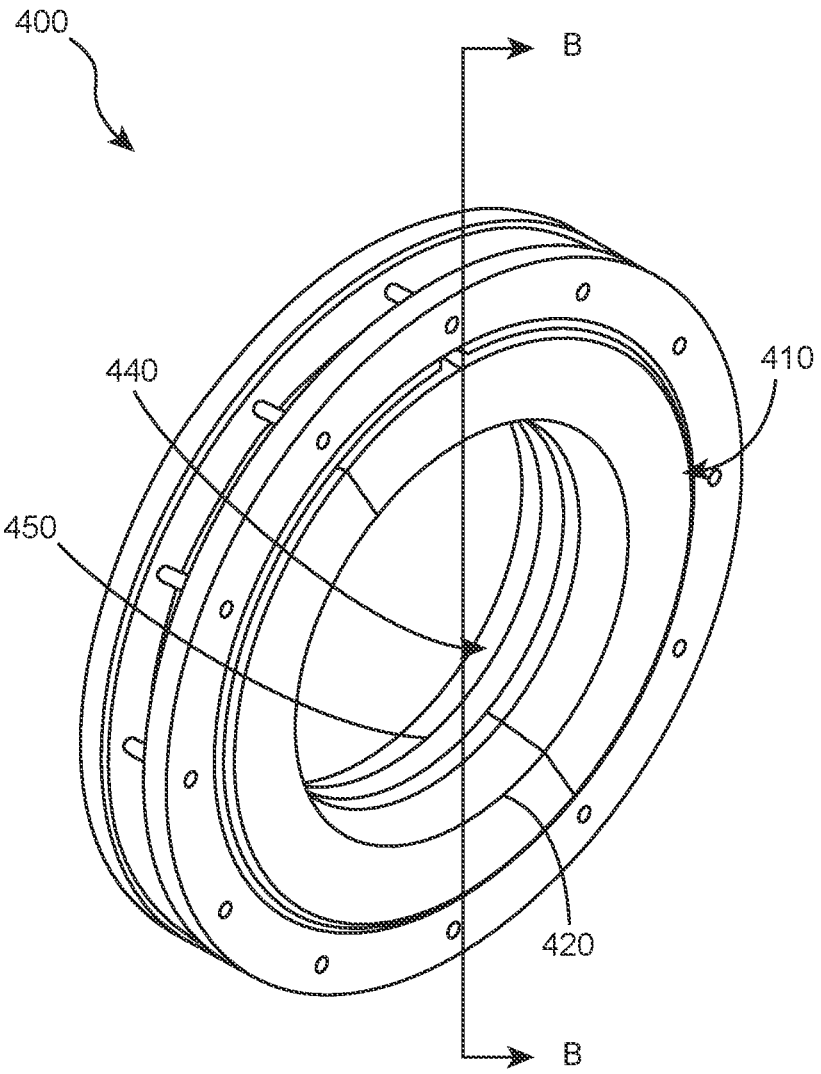
FIGS. 4A through 4C illustrate an alternative embodiment of an adjustable split thrust ring manufactured in accordance with the disclosure.

Turning to FIG. 4A, illustrated is a perspective view of another embodiment of an adjustable split thrust ring 400 manufactured in accordance with the disclosure. As can be seen in FIG. 4A, the adjustable split thrust ring 400 includes a downhole split ring 410 comprising two or more separate downhole pieces configured to fit together to form a substantially circular downhole shoulder 420. As can further be seen in FIG. 4A, the adjustable split thrust ring 400 includes an uphole split ring 440 positioned proximate the downhole split ring 410 and comprising two or more separate uphole pieces, the two or more separate uphole pieces configured to fit together to form a substantially circular uphole shoulder 450.

Figure 4B:
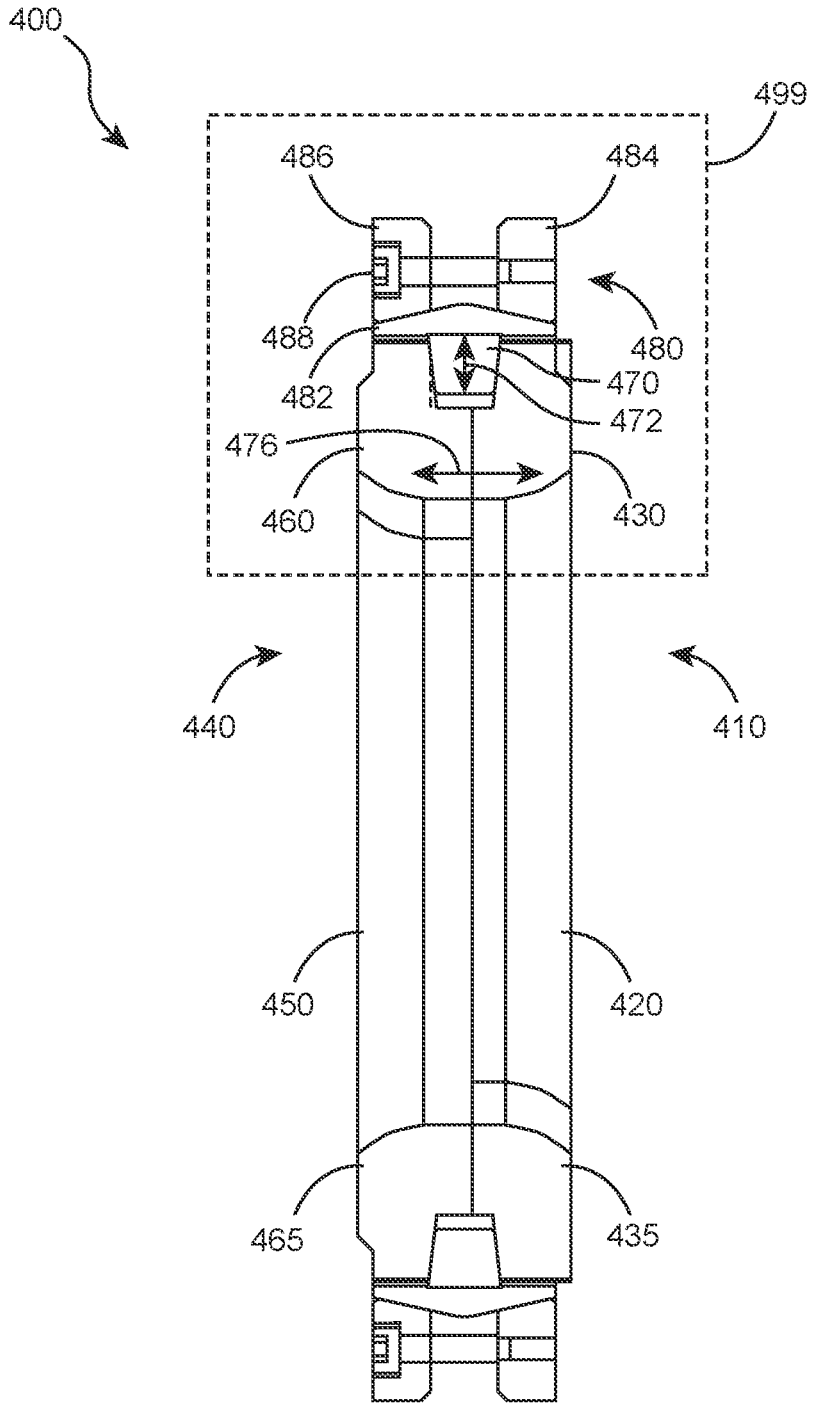

Turning now to FIG. 4B, illustrated is a cross-sectional view of the adjustable split thrust ring 400 illustrated in FIG. 4A taken through the line B-B. As can be seen in FIG. 4B, the adjustable split thrust ring 400 includes the downhole split ring 410 including two separate downhole pieces 430, 435 configured to fit together to form the substantially circular downhole shoulder 420. As can further be seen in FIG. 4B, the adjustable split thrust ring 400 includes the uphole split ring 440 positioned proximate the downhole split ring 410 and including two separate uphole pieces 460, 465, the two or more separate uphole pieces 460, 465 configured to fit together to form the substantially circular uphole shoulder 450.

As shown in the embodiment of FIG. 4B, the adjustable split thrust ring 400 further includes one or more wedges 470 positioned between associated ones of the two separate downhole pieces 430, 435 and the two separate uphole pieces 460, 465. The wedge 470, in the embodiment of FIG. 4B, is configured to travel radially (e.g., as shown by the arrow 472) to move the substantially circular downhole shoulder 420 and the substantially circular uphole shoulder 450 relative to one another. In the illustrated embodiment, the wedge 470 is configured to travel radially inward to move the substantially circular downhole shoulder 420 and the substantially circular uphole shoulder 450 axially (e.g., as shown by the arrow 476) outward relative to one another.

The adjustable split thrust ring 400 of FIG. 4B additionally includes a taper lock mechanism 480. The taper lock mechanism 480 at least partially surrounds the two separate downhole pieces 430, 435 and the two separate uphole pieces 460, 465 to engage the wedge 470. As is illustrated, the taper lock mechanism 480 is configured to move and thereby cause the wedge 470 to travel radially inward.

The taper lock mechanism 480 illustrated in FIG. 4B includes a taper lock ring 482 positioned on an exposed portion of the wedge 470, a downhole lock ring 484 and an uphole lock ring 486 positioned on corresponding tapered portions of the taper lock ring 482, and an adjustment mechanism 488 axially connecting the downhole lock ring 484 and the uphole lock ring 486. In the embodiment shown, the adjustment mechanism 488 is configured to draw the downhole lock ring 484 and uphole lock ring 486 toward one another and press upon the taper lock ring 482 and thereby cause the wedge 470 to travel radially inward.

Figure 4C:
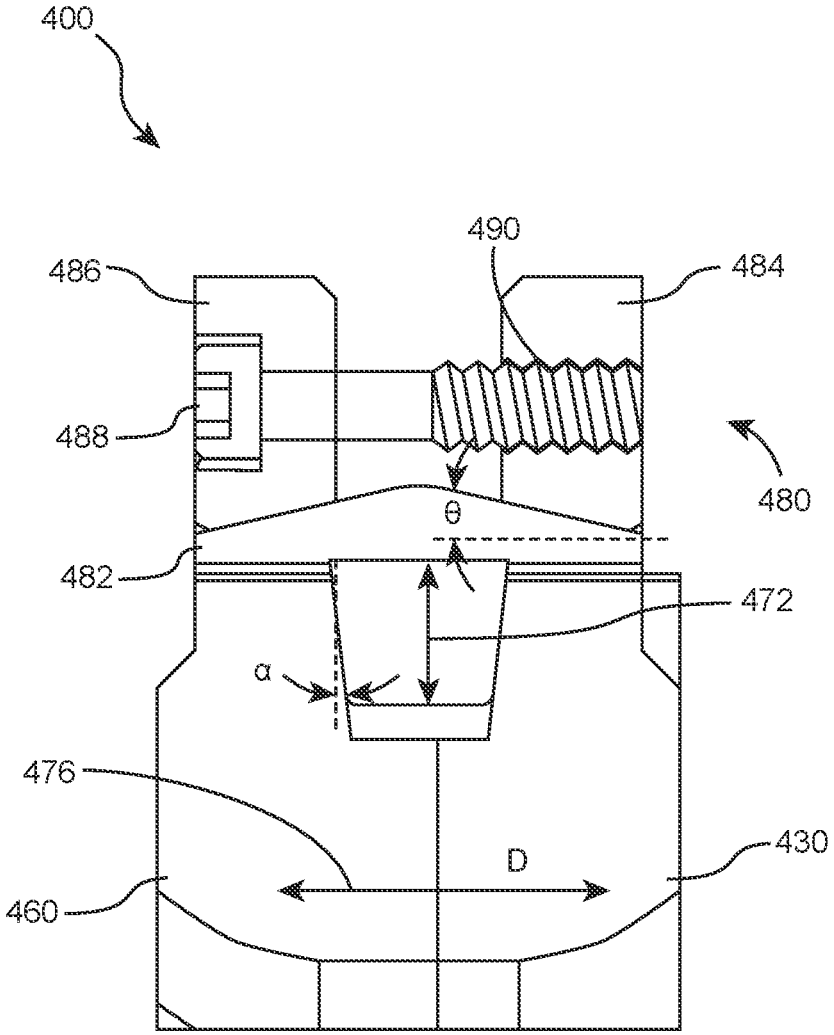

Turning to FIG. 4C, illustrated is a zoomed in portion of the adjustable split thrust ring 400 of FIG. 4B as denoted by the dashed box 499. As illustrated in FIG. 4C, the adjustment mechanism 488 is an adjustment bolt engaging threads 490 in the downhole lock ring 484. Other adjustment mechanisms 488, apart from the adjustment bolt illustrated in FIG. 4B, are within the purview of the present disclosure.

The wedge 470, similar to the wedge 370 of FIG. 3C, may be manufactured in many different ways to achieve the purposes of the present disclosure. In one embodiment, the wedge 470 has an angle (α) that is small enough to allow fine adjustments to the relative axial movement of the substantially circular downhole shoulder 420 and substantially circular uphole should 450 with the radial movement of the wedge 470. In one embodiment, the angle (α) of wedge 470 is less than about 30 degrees, yet in other embodiments the angle (α) is less than about 15 degrees, and even yet other embodiments (e.g., wherein extremely fine adjustment is required) less than about 10 degrees.

The taper lock ring 482 may also have an angle (θ) that is small enough to allow for the fine adjustments to the relative axial movement of the substantially circular downhole shoulder 420 and substantially circular uphole should 450 with the radial movement of the wedge 470. In one embodiment, the angle (θ) of the taper lock ring 482 is less than about 45 degrees, yet in other embodiments the angle (θ) is less than about 30 degrees, and even yet other embodiments (e.g., wherein the extremely fine adjustment is required) less than about 20 degrees.

Figure 5A:
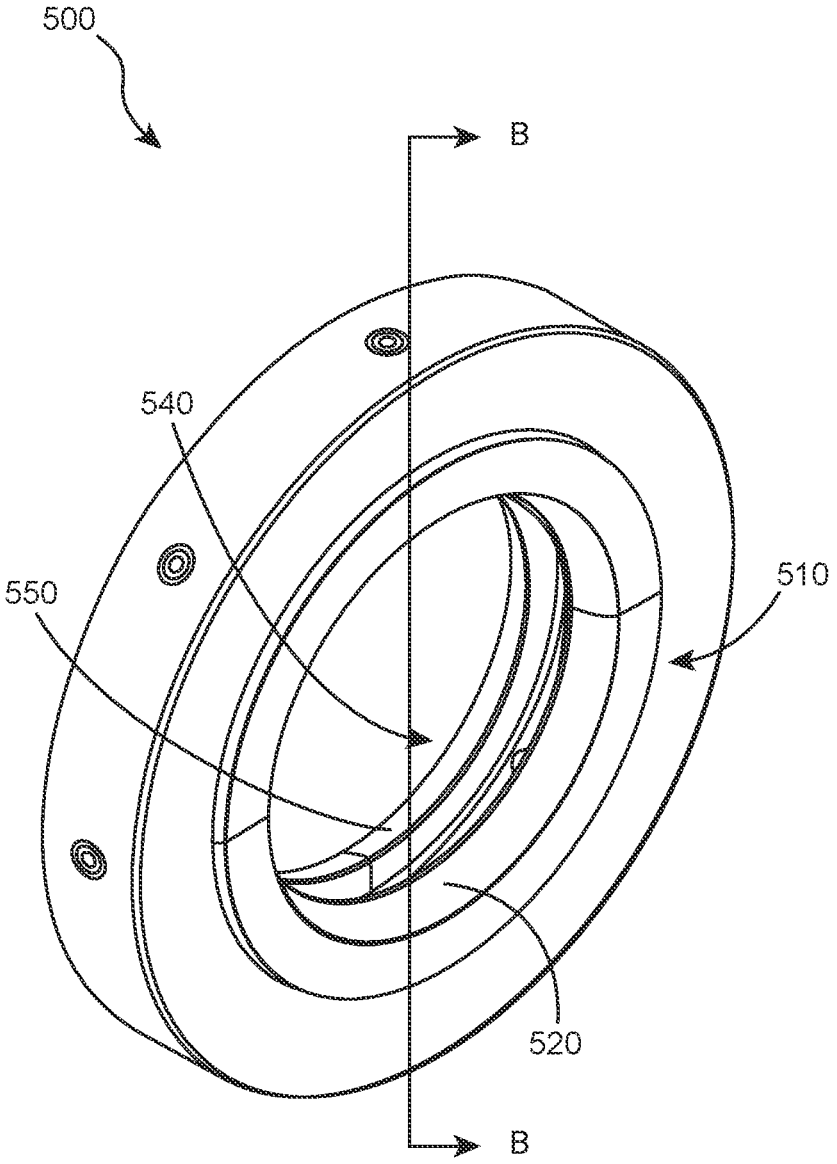
FIGS. 5A through 5C illustrate an alternative embodiment of an adjustable split thrust ring manufactured in accordance with the disclosure.

Turning to FIG. 5A, illustrated is a perspective view of another embodiment of an adjustable split thrust ring 500 manufactured in accordance with the disclosure. As can be seen in FIG. 5A, the adjustable split thrust ring 500 includes a downhole split ring 510 comprising two or more separate downhole pieces configured to fit together to form a substantially circular downhole shoulder 520. As can further be seen in FIG. 5A, the adjustable split thrust ring 500 includes an uphole split ring 540 positioned proximate the downhole split ring 510 and comprising two or more separate uphole pieces, the two or more separate uphole pieces configured to fit together to form a substantially circular uphole shoulder 550.

Figure 5B:
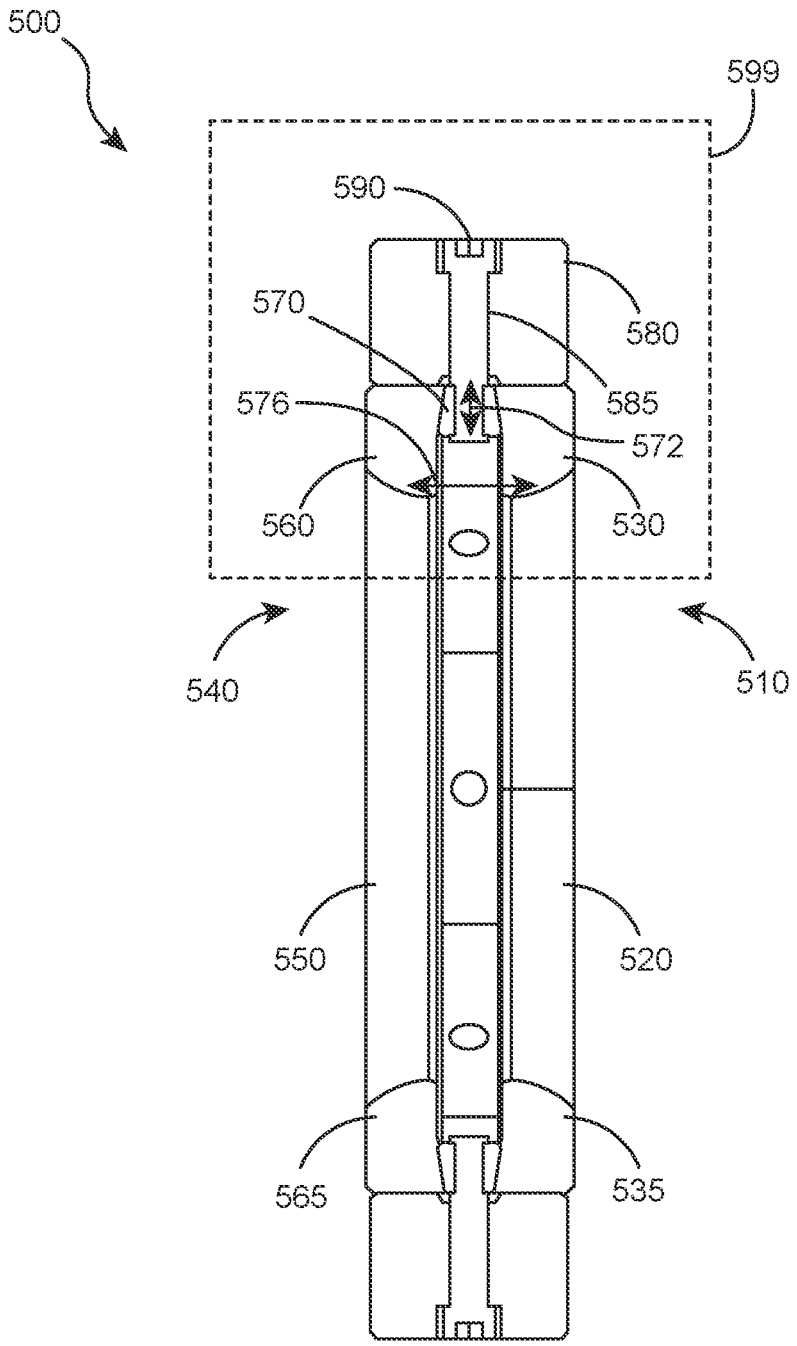

Turning now to FIG. 5B, illustrated is a cross-sectional view of the adjustable split thrust ring 500 illustrated in FIG. 5A taken through the line B-B. As can be seen in FIG. 5B, the adjustable split thrust ring 500 includes the downhole split ring 510 including two separate downhole pieces 530, 535 configured to fit together to form the substantially circular downhole shoulder 520. As can further be seen in FIG. 5B, the adjustable split thrust ring 500 includes the uphole split ring 540 positioned proximate the downhole split ring 510 and including two separate uphole pieces 560, 565, the two or more separate uphole pieces 560, 565 configured to fit together to form the substantially circular uphole shoulder 550.

As shown in the embodiment of FIG. 5B, the adjustable split thrust ring 500 further includes one or more wedges 570 positioned between associated ones of the two separate downhole pieces 530, 535 and the two separate uphole pieces 560, 565. The wedge 570, in the embodiment of FIG. 5B, is configured to travel radially (e.g., as shown by the arrow 572) to move the substantially circular downhole shoulder 520 and the substantially circular uphole shoulder 550 relative to one another. In the illustrated embodiment, the wedge 570 is configured to travel radially outward to move the substantially circular downhole shoulder 520 and the substantially circular uphole shoulder 550 axially (e.g., as shown by the arrow 576) outward relative to one another.

The adjustable split thrust ring 500 of FIG. 5B additionally includes a support ring 580. The support ring 580, in the embodiment shown, is configured to surround at least a portion of the two separate downhole pieces 530, 535 and the two separate uphole pieces 560, 565. The support ring 580 has an opening 585 there through for an adjustment mechanism 590 to extend to engage the wedge 570. In the embodiment of FIG. 5B, the adjustment mechanism 590 is configured to draw the wedge 570 radially outward to move the substantially circular downhole shoulder 520 and the substantially circular uphole shoulder 550 axially outward relative to one another.

Figure 5C:
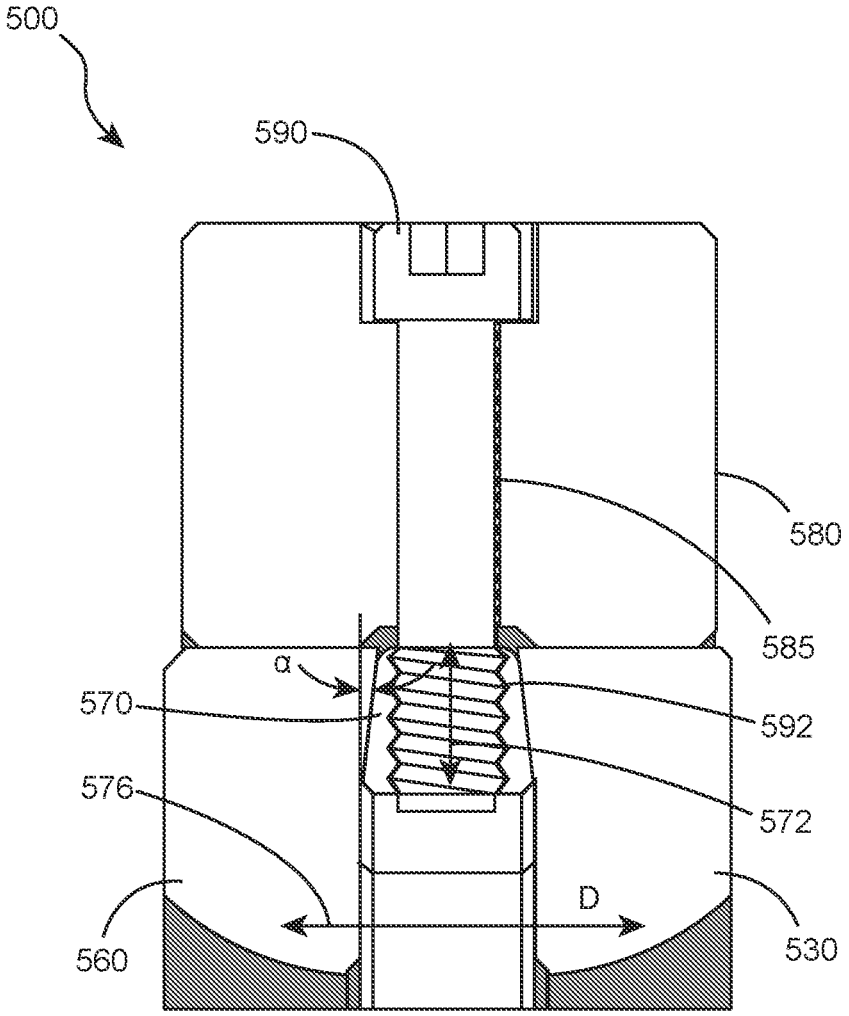

Turning to FIG. 5C, illustrated is a zoomed in portion of the adjustable split thrust ring 500 of FIG. 5B as denoted by the dashed box 599. As illustrated in FIG. 5C, the adjustment mechanism 590 is an adjustment bolt engaging threads 592 in the wedge 570 (e.g., a threaded wedge in this embodiment). Other adjustment mechanisms 590, apart from the adjustment bolt illustrated in FIG. 5B, are within the purview of the present disclosure.

The wedge 570, similar to the wedge 370 of FIG. 3C, may be manufactured in many different ways to achieve the purposes of the present disclosure. In one embodiment, the wedge 570 has an angle ($\alpha$) that is small enough to allow fine adjustments to the relative axial movement of the substantially circular downhole shoulder 520 and substantially circular uphole should 550 with the radial movement of the wedge 570. In one embodiment, the angle ($\alpha$) of wedge 570 is less than about 30 degrees, yet in other embodiments the angle ($\alpha$) is less than about 15 degrees, and even yet other embodiments (e.g., wherein extremely fine adjustment is required) less than about 10 degrees. The wedge 570, in comparison to the wedge 370 of FIGS. 3A through 3C, has an opposite slant direction.

Figure 6A:
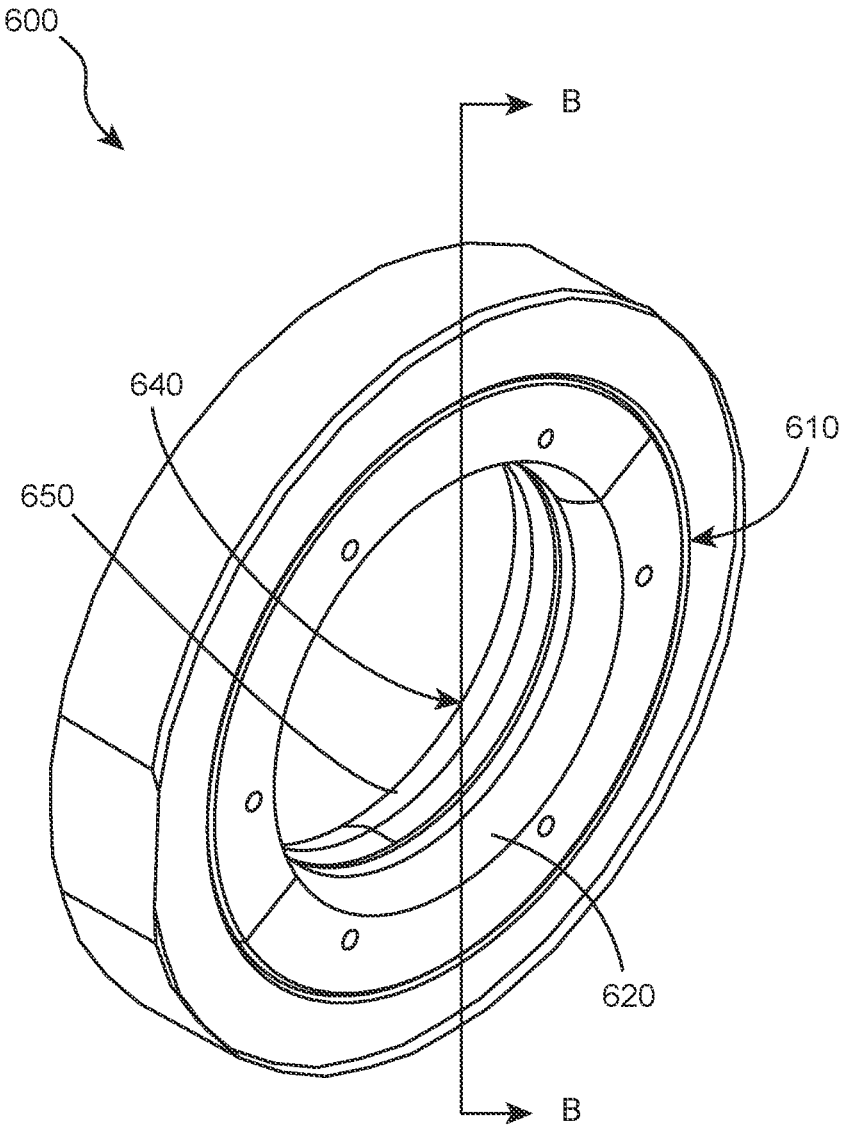
FIGS. 6A through 6C illustrate an alternative embodiment of an adjustable split thrust ring manufactured in accordance with the disclosure.

Turning to FIG. 6A, illustrated is a perspective view of another embodiment of an adjustable split thrust ring 600 manufactured in accordance with the disclosure. As can be seen in FIG. 6A, the adjustable split thrust ring 600 includes a downhole split ring 610 comprising two or more separate downhole pieces configured to fit together to form a substantially circular downhole shoulder 620. As can further be seen in FIG. 6A, the adjustable split thrust ring 600 includes an uphole split ring 640 positioned proximate the downhole split ring 610 and comprising two or more separate uphole pieces, the two or more separate uphole pieces configured to fit together to form a substantially circular uphole shoulder 650.

Figure 6B:
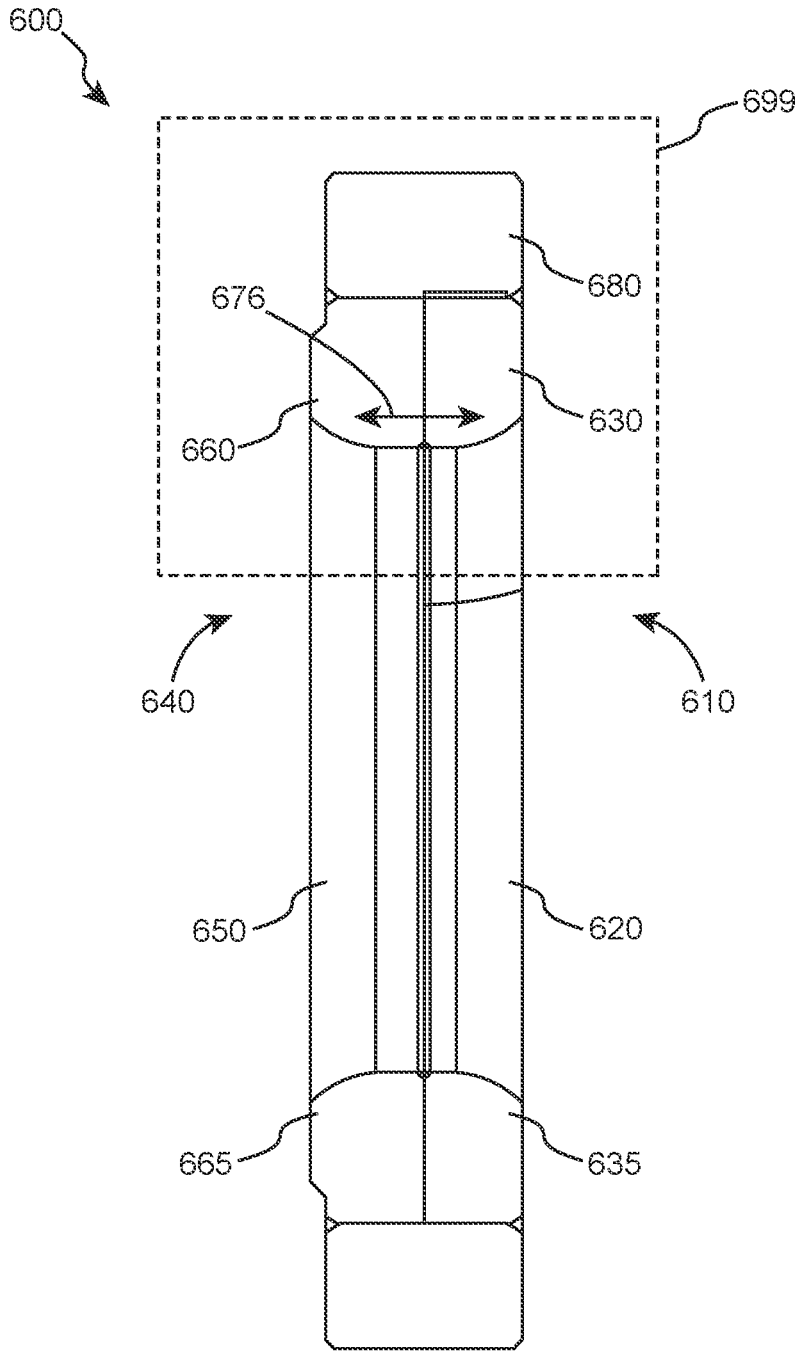

Turning now to FIG. 6B, illustrated is a cross-sectional view of the adjustable split thrust ring 600 illustrated in FIG. 6A taken through the line B-B. As can be seen in FIG. 6B, the adjustable split thrust ring 600 includes the downhole split ring 610 including two separate downhole pieces 630, 635 configured to fit together to form the substantially circular downhole shoulder 620. As can further be seen in FIG. 6B, the adjustable split thrust ring 600 includes the uphole split ring 640 positioned proximate the downhole split ring 610 and including two separate uphole pieces 660, 665, the two or more separate uphole pieces 660, 665 configured to fit together to form the substantially circular uphole shoulder 650.

As shown in the embodiment of FIG. 6B, the adjustable split thrust ring 600 further includes a lock ring 680 configured to surround at least a portion of the two separate downhole pieces 630, 635 and the two separate uphole pieces 660, 665. In this embodiment, the lock ring 680 is configured to allow the substantially circular downhole shoulder 620 and the substantially circular uphole shoulder 650 to move axially outward (e.g., as shown by the arrow 676) relative to one another.

Figure 6C:
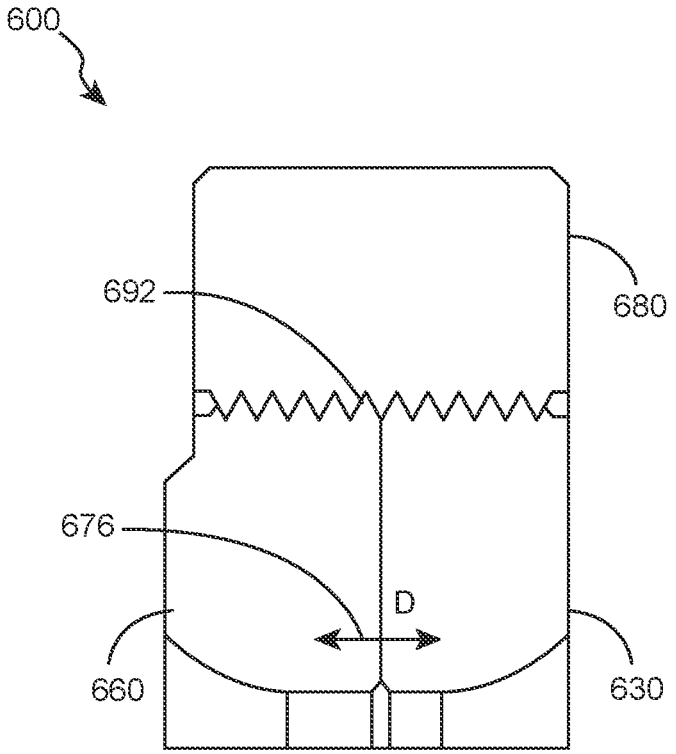

Turning to FIG. 6C, illustrated is a zoomed in portion of the adjustable split thrust ring 600 of FIG. 6B as denoted by the dashed box 699. As illustrated in FIG. 6C, the lock ring 680 is a threaded lock ring, and the two separate downhole pieces 630, 635 and two separate uphole pieces 660, 665 have corresponding lock ring threads 692. In the embodiment of FIG. 6C, one of the two separate downhole pieces 630, 635 or two separate uphole pieces 660, 665 are configured to rotate relative to the other of the two separate downhole pieces 630, 635 or two separate uphole pieces 660, 665 and the threaded lock ring 680. Accordingly, the substantially circular downhole shoulder 620 and the substantially circular uphole shoulder 650 can move axially outward relative to one another.

While not shown in FIG. 6C, holes may be positioned a side of the downhole split ring 610 or side of the uphole split ring 640. In this embodiment, the holes may be used to mate with a tool, whereby the downhole split ring 610 or uphole split ring 640 may rotate relative to the other of the downhole split ring 610 or uphole split ring 640 and the lock ring 680. One embodiment of the holes may be found in FIG. 6A.

Figure 7A:
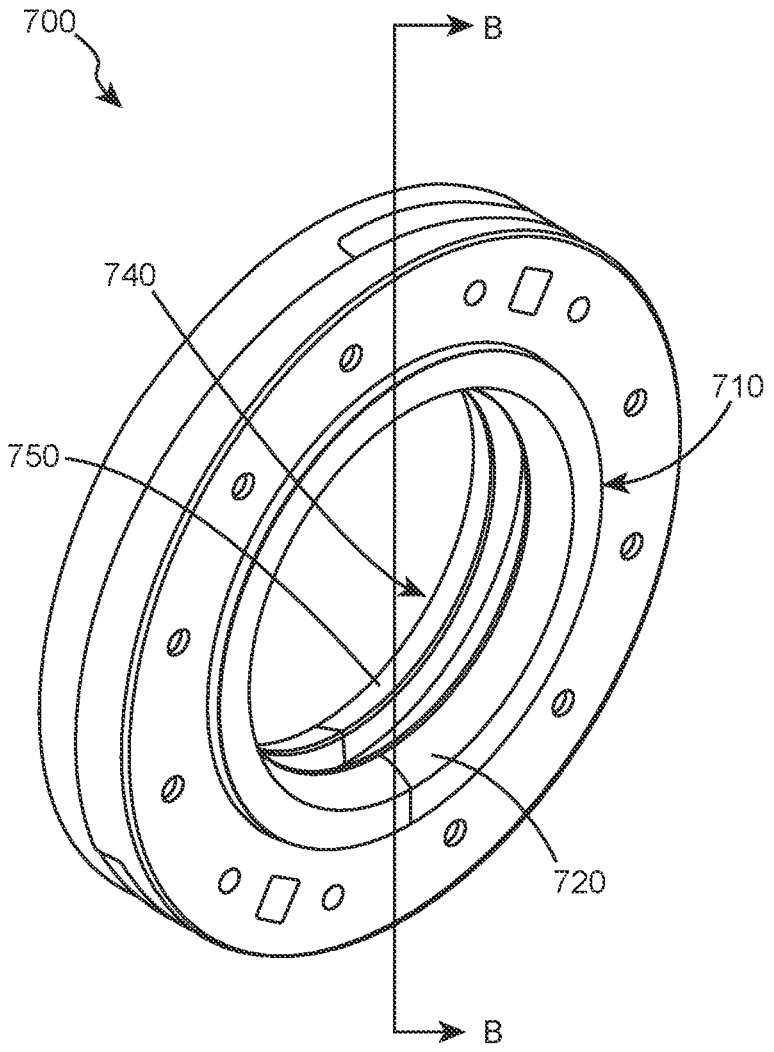
FIGS. 7A through 7C illustrate an alternative embodiment of an adjustable split thrust ring manufactured in accordance with the disclosure.

Turning to FIG. 7A, illustrated is a perspective view of another embodiment of an adjustable split thrust ring 700 manufactured in accordance with the disclosure. As can be seen in FIG. 7A, the adjustable split thrust ring 700 includes a downhole split ring 710 comprising two or more separate downhole pieces configured to fit together to form a substantially circular downhole shoulder 720. As can further be seen in FIG. 7A, the adjustable split thrust ring 700 includes an uphole split ring 740 positioned proximate the downhole split ring 710 and comprising two or more separate uphole pieces, the two or more separate uphole pieces configured to fit together to form a substantially circular uphole shoulder 750.

Figure 7B:
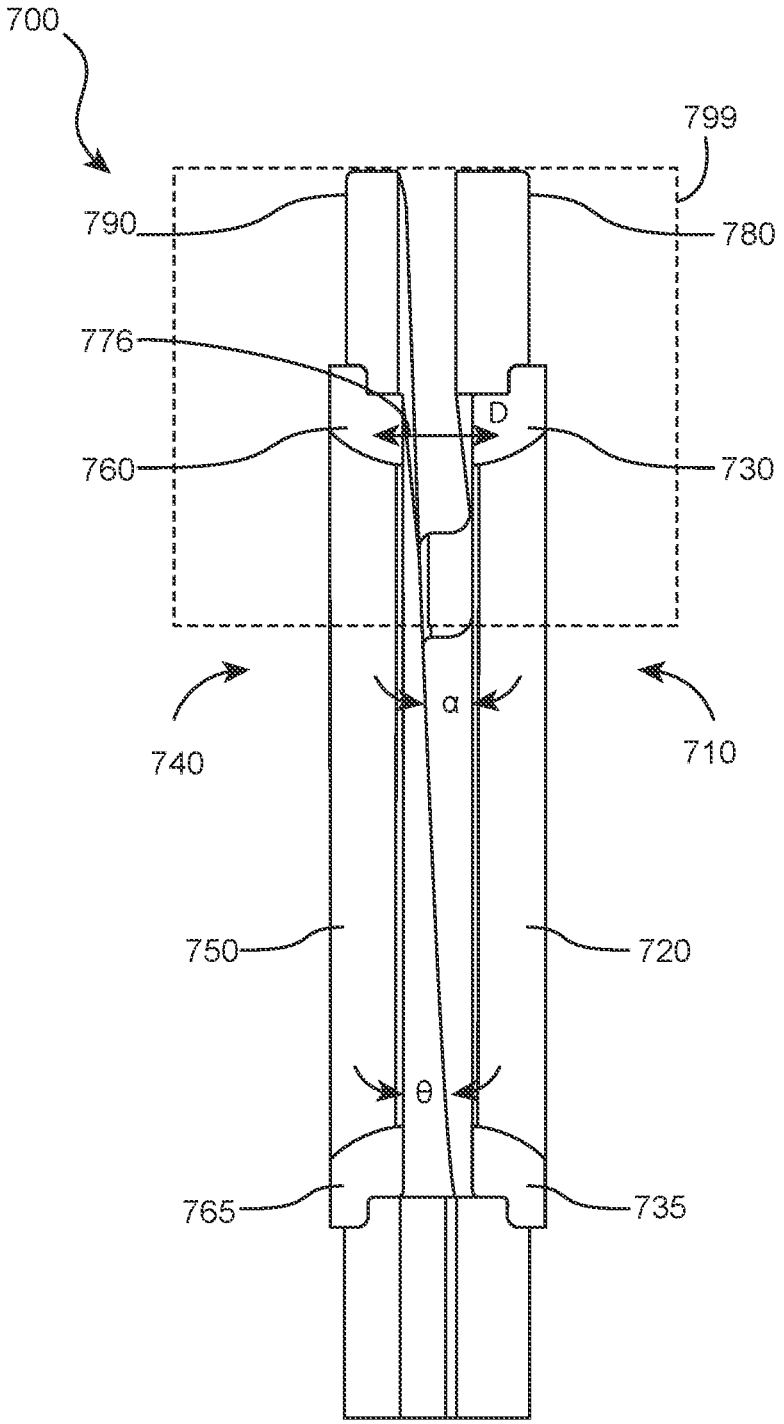

Turning now to FIG. 7B, illustrated is a cross-sectional view of the adjustable split thrust ring 700 illustrated in FIG. 7A taken through the line B-B. As can be seen in FIG. 7B, the adjustable split thrust ring 700 includes the downhole split ring 710 including two separate downhole pieces 730, 735 configured to fit together to form the substantially circular downhole shoulder 720. As can further be seen in FIG. 7B, the adjustable split thrust ring 700 includes the uphole split ring 740 positioned proximate the downhole split ring 710 and including two separate uphole pieces 760, 765, the two or more separate uphole pieces 760, 765 configured to fit together to form the substantially circular uphole shoulder 750.

As shown in the embodiment of FIG. 7B, the adjustable split thrust ring 700 further includes a downhole ramp 780. The downhole ramp 780, in the embodiment shown, at least partially surrounds the two separate downhole pieces 730, 735. The adjustable split thrust ring 700 additionally includes an uphole ramp 790, the uphole ramp 790 at least partially surrounding the two separate uphole pieces 760, 765. In the illustrated embodiment, the downhole ramp 780 and uphole ramp 790 have a corresponding downhole ramp angle ($\alpha$) and uphole ramp angle ($\theta$) that engage each other such that when the downhole ramp 780 and uphole ramp 790 are rotated relative to one another, the substantially circular downhole shoulder 720 and the substantially circular uphole shoulder 750 move axially (e.g., as shown by the arrow 776) outward relative to one another.

The downhole ramp 780 and uphole ramp 790 may be manufactured in many different ways to achieve the purposes of the present disclosure. In one embodiment, the downhole ramp 780 and uphole ramp 790 may have a similar downhole ramp angle ($\alpha$) and uphole ramp angle ($\theta$). For example, the downhole ramp angle ($\alpha$) and uphole ramp angle ($\theta$) may be small enough to allow fine adjustments to the relative axial movement of the substantially circular downhole shoulder 720 and substantially circular uphole shoulder 750. In one embodiment, the downhole ramp angle ($\alpha$) and uphole ramp angle ($\theta$) are less than about 30 degrees, yet in other embodiments the downhole ramp angle ($\alpha$) and uphole ramp angle ($\theta$) are less than about 15 degrees, and even yet other embodiments (e.g., wherein extremely fine adjustment is required) less than about 10 degrees. These smaller angle additional make it more difficult for the substantially circular downhole shoulder 720 and substantially circular uphole shoulder 750 to back off from one another.

Figure 7C:
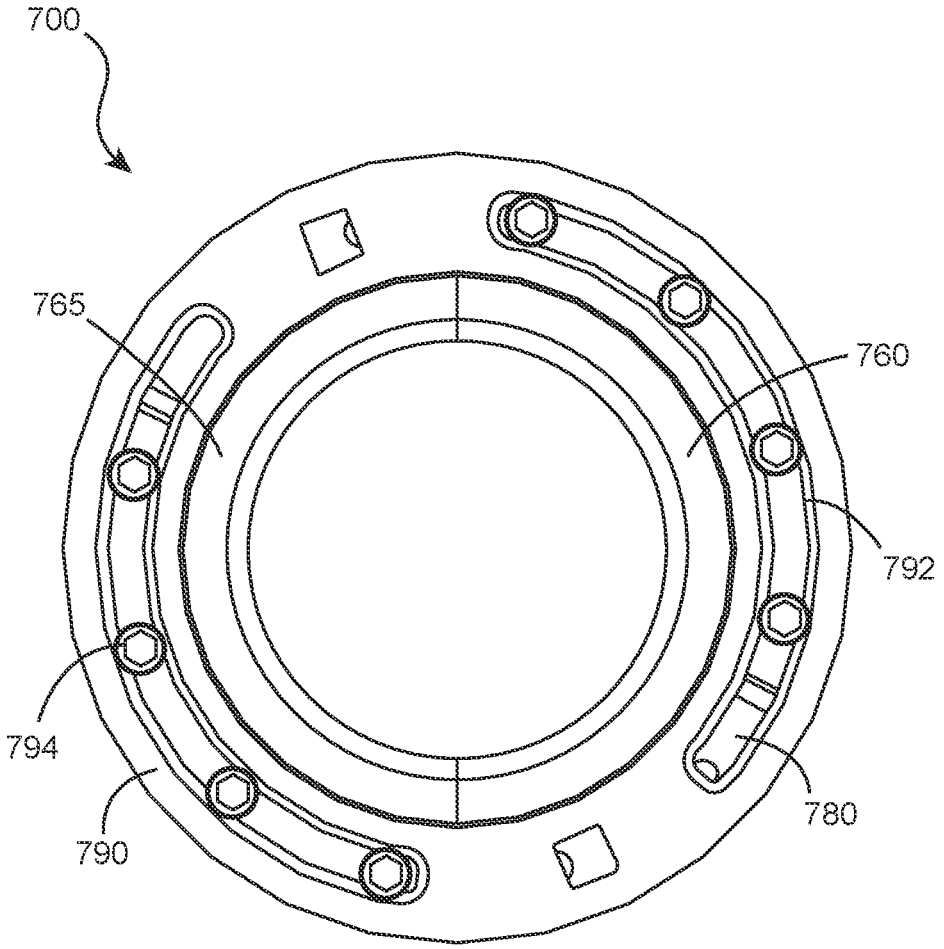

Turning briefly to FIG. 7C, illustrated is a side view of the adjustable split thrust ring 700 of FIG. 7A. As may be seen in FIG. 7C, at least one of the downhole ramp 780 or uphole ramp 790 may have one or more openings 792 in a side surface thereof. In the embodiment of FIG. 7C, the openings 792 are configured as slots, and are located in the uphole ramp 790. In this embodiment, one or more locking mechanisms 794 extend through the one or more openings 792 to engage the other of the downhole ramp 780 or uphole ramp 790, which in this embodiment happens to be the downhole ramp 780. Specific to the embodiment of FIG. 7C, the one or more locking mechanisms 794 engage threaded openings in the other of the downhole ramp 780 or uphole ramp 790, in this embodiment the downhole ramp 780.

Embodiments disclosed herein include:

A. An adjustable split thrust ring, comprising, a downhole split ring including two or more separate downhole pieces, the two or more separate downhole pieces configured to fit together to form a substantially circular downhole shoulder, and an uphole split ring positionable proximate the downhole split ring and including two or more separate uphole pieces, the two or more separate uphole pieces configured to fit together to form a substantially circular uphole shoulder, and further wherein the substantially circular downhole shoulder and the substantially circular uphole shoulder are configured to move relative to one another to adjust to fit a groove in a driveshaft that they are configured to sit.

B. A well drilling system, comprising, a housing defining a longitudinal dimension, a driveshaft positioned within the housing, wherein the housing and driveshaft are operable to slide relative to one another along the longitudinal dimension, and rotate relative to one another, and further wherein the driveshaft has a groove surrounding a circumference thereof, and an adjustable split thrust ring positioned between the housing and the driveshaft, the adjustable split thrust configured to transfer an axial load between the housing and the driveshaft. In this embodiment, the adjustable split thrust ring includes a downhole split ring including two or more separate downhole pieces, the two or more separate downhole pieces fit together to form a substantially circular downhole shoulder, and an uphole split ring positioned proximate the downhole split ring and including two or more separate uphole pieces, the two or more separate uphole pieces fit together to form a substantially circular uphole shoulder, and further wherein the substantially circular downhole shoulder and the substantially circular uphole shoulder sit within the groove in the driveshaft and move relative to one another to adjust for changes in the groove shape.

Each of the embodiments A and B may have one or more of the following additional elements in combination:

Element 1: wherein the substantially circular downhole shoulder and the substantially circular uphole shoulder are configured to move axially relative to one another. Element 2: further including a wedge positioned between associated ones of the two or more separate downhole pieces and the two or more separate uphole pieces, the wedge configured to travel radially to move the substantially circular downhole shoulder and the substantially circular uphole shoulder relative to one another. Element 3: wherein the wedge is configured to travel radially inward to move the substantially circular downhole shoulder and the substantially circular uphole shoulder axially outward relative to one another. Element 4: further including a tapered lock ring configured to at least partially surround the two or more separate downhole pieces or the two or more separate uphole pieces and engage the wedge, the tapered lock ring further configured to move axially and thereby cause the wedge to travel radially inward. Element 5: wherein the tapered lock ring and the two or more separate downhole pieces or the two or more separate uphole pieces have corresponding tapered lock ring threads, and further wherein the tapered lock ring and the two or more separate downhole pieces or the two or more separate uphole pieces are configured to spin relative to one another to move the tapered lock ring axially and thereby cause the wedge to travel radially inward. Element 6: further including a lock ring configured to at least partially surround the other of the two or more separate downhole pieces or the two or more separate uphole pieces, the lock ring configured to abut up next to the tapered lock ring and thereby prevent the tapered lock ring from unintended movement based upon vibrations in the adjustable split thrust ring. Element 7: wherein the lock ring and the other of the two or more separate downhole pieces or two or more separate uphole pieces have corresponding lock ring threads, and further wherein the lock ring and the other of the two or more separate downhole pieces or two or more separate uphole pieces are configured to spin relative to one another to cause the lock ring to abut up next to the tapered lock ring. Element 8: further including a taper lock mechanism configured to at least partially surround the two or more separate downhole pieces and the two or more separate uphole pieces and engage the wedge, the taper lock mechanism configured to move and thereby cause the wedge to travel radially inward. Element 9: wherein the taper lock mechanism includes a taper lock ring positioned on an exposed portion of the wedge, a downhole lock ring and an uphole lock ring positioned on corresponding tapered portions of the taper lock ring, and an adjustment mechanism axially connecting the downhole lock ring and the uphole lock ring, the adjustment mechanism configured to draw the downhole lock ring and uphole lock ring toward one another and press upon the taper lock ring and thereby cause the wedge to travel radially inward. Element 10: wherein the adjustment mechanism is an adjustment bolt engaging threads in the downhole lock ring or the uphole lock ring. Element 11: wherein the wedge is configured to travel radially outward to move the substantially circular downhole shoulder and the substantially circular uphole shoulder axially outward relative to one another. Element 12: further including a support ring configured to surround at least a portion of the two or more separate downhole pieces and the two or more separate uphole pieces, the support ring having an opening there through for an adjustment mechanism to extend to engage the wedge, the adjustment mechanism configured to draw the wedge radially outward to move the substantially circular downhole shoulder and the substantially circular uphole shoulder axially outward relative to one another. Element 13: wherein the wedge is a threaded wedge, and the adjustment mechanism is a bolt, and further wherein the bolt is configured rotate to draw the wedge radially outward to move the substantially circular downhole shoulder and the substantially circular uphole shoulder axially outward relative to one another. Element 14: further including a lock ring configured to surround at least a portion of the two or more separate downhole pieces and the two or more separate uphole pieces, the lock ring configured to allow the substantially circular downhole shoulder and the substantially circular uphole shoulder to move axially outward relative to one another. Element 15: wherein the lock ring is a threaded lock ring, and the two or more separate downhole pieces and two or more separate uphole pieces have corresponding lock ring threads, and further wherein one of the two or more separate downhole pieces or two or more separate uphole pieces are configured to rotate relative to the other of the two or more separate downhole pieces or two or more separate uphole pieces and the threaded lock ring, thereby moving the substantially circular downhole shoulder and the substantially circular uphole shoulder axially outward relative to one another. Element 16 wherein the two or more separate downhole pieces are at least partially surrounded by a downhole ramp, and the two or more separate uphole pieces are at least partially surrounded by an uphole ramp, the downhole ramp and uphole ramp having a corresponding downhole ramp angle and uphole ramp angle that engage each other such that when the downhole ramp and uphole ramp are rotated relative to one another, the substantially circular downhole shoulder and the substantially circular uphole shoulder move axially outward relative to one another. Element 17: wherein at least one of the downhole ramp or uphole ramp have one or more openings in a side surface thereof, and further wherein one or more locking mechanisms extend through the one or more openings to engage the other of the downhole ramp or uphole ramp to thereby lock a relative axial position of the substantially circular downhole shoulder and the substantially circular uphole shoulder. Element 18: wherein the one or more openings are one or more slots and the one or more locking mechanisms are one or more bolts, and further wherein the other of the downhole ramp or uphole ramp has one or more threaded openings therein configured to engage the one or more bolts extending through the one or more slots. Element 19: wherein the substantially circular downhole shoulder and the substantially circular uphole shoulder are configured to move axially by up to about 30 mm relative to one another.

Those skilled in the art to which this application relates will appreciate that other and further additions, deletions, substitutions and modifications may be made to the described embodiments.

What is claimed is:

1. An adjustable split thrust ring, comprising:

a downhole split ring including two or more separate downhole pieces, the two or more separate downhole pieces fitting together to form a substantially circular downhole shoulder fitable on a substantially circular driveshaft;

an uphole split ring positionable proximate the downhole split ring and including two or more separate uphole pieces, the two or more separate uphole pieces fitting together to form a substantially circular uphole shoulder fitable on the substantially circular driveshaft, and further wherein the substantially circular downhole shoulder and the substantially circular uphole shoulder are movable relative to one another to adjust to fit a groove in a driveshaft; and a lock ring surrounding at least a portion of the two or more separate downhole pieces and the two or more separate uphole pieces, the lock ring configured to rotate relative to at least one of the downhole split ring or the uphole split ring to axially move the substantially circular downhole shoulder and the substantially circular uphole shoulder relative to one another.

2. The adjustable split thrust ring as recited in claim 1, wherein the substantially circular downhole shoulder and the substantially circular uphole shoulder are axially movable relative to one another.

3. The adjustable split thrust ring as recited in claim 2, wherein the two or more separate downhole pieces are at least partially surrounded by a downhole ramp, and the two or more separate uphole pieces are at least partially surrounded by an uphole ramp, the downhole ramp and uphole ramp having a corresponding downhole ramp angle and uphole ramp angle that engage each other such that when the downhole ramp and uphole ramp are rotated relative to one another, the substantially circular downhole shoulder and the substantially circular uphole shoulder move axially outward relative to one another.

4. The adjustable split thrust ring as recited in claim 3, wherein at least one of the downhole ramp or uphole ramp have one or more openings in a side surface thereof, and further wherein one or more locking mechanisms extend through the one or more openings to engage the other of the downhole ramp or uphole ramp to thereby lock a relative axial position of the substantially circular downhole shoulder and the substantially circular uphole shoulder.

5. The adjustable split thrust ring as recited in claim 4, wherein the one or more openings are one or more slots and the one or more locking mechanisms are one or more bolts, and further wherein the other of the downhole ramp or uphole ramp has one or more threaded openings therein configured to engage the one or more bolts extending through the one or more slots.

6. The adjustable split thrust ring as recited in claim 3, wherein the downhole ramp angle and uphole ramp angle are substantially the same.

7. The adjustable split thrust ring as recited in claim 6, wherein the downhole ramp angle and uphole ramp angle are less than about 15 degrees.

8. The adjustable split thrust ring as recited in claim 2, wherein the substantially circular downhole shoulder and the substantially circular uphole shoulder are configured to move axially by up to about 30 mm relative to one another.

9. The adjustable split thrust ring as recited in claim 1, wherein the lock ring is a threaded lock ring, and the two or more separate downhole pieces and two or more separate uphole pieces have corresponding lock ring threads, and further wherein one of the two or more separate downhole pieces or two or more separate uphole pieces rotate relative to the other of the two or more separate downhole pieces or two or more separate uphole pieces and the threaded lock ring, thereby moving the substantially circular downhole shoulder and the substantially circular uphole shoulder axially outward relative to one another.

10. A well drilling system, comprising:

a housing defining a longitudinal dimension;

a driveshaft positioned within the housing, wherein the housing and driveshaft are operable to slide relative to one another along the longitudinal dimension, and rotate relative to one another, and further wherein the driveshaft has a groove surrounding a circumference thereof; and an adjustable split thrust ring positioned between the housing and the driveshaft, the adjustable split thrust configured to transfer an axial load between the housing and the driveshaft, and including;

a downhole split ring including two or more separate downhole pieces, the two or more separate downhole pieces fit together to form a substantially circular downhole shoulder surrounding the driveshaft;

an uphole split ring positioned proximate the downhole split ring and including two or more separate uphole pieces, the two or more separate uphole pieces fit together to form a substantially circular uphole shoulder surrounding the driveshaft, and further wherein the substantially circular downhole shoulder and the substantially circular uphole shoulder sit within the groove in the driveshaft and move relative to one another to adjust for changes in the groove shape; and a lock ring surrounding at least a portion of the two or more separate downhole pieces and the two or more separate uphole pieces, the lock ring configured to rotate relative to at least one of the downhole split ring or the uphole split ring to axially move the substantially circular downhole shoulder and the substantially circular uphole shoulder relative to one another.

11. The well drilling system as recited in claim 10, wherein the substantially circular downhole shoulder and the substantially circular uphole shoulder are axially movable relative to one another.

12. The well drilling system as recited in claim 11, wherein the two or more separate downhole pieces are at least partially surrounded by a downhole ramp, and the two or more separate uphole pieces are at least partially surrounded by an uphole ramp, the downhole ramp and uphole ramp having a corresponding downhole ramp angle and uphole ramp angle that engage each other such that when the downhole ramp and uphole ramp are rotated relative to one another, the substantially circular downhole shoulder and the substantially circular uphole shoulder move axially outward relative to one another.

13. The well drilling system as recited in claim 12, wherein at least one of the downhole ramp or uphole ramp have one or more openings in a side surface thereof, and further wherein one or more locking mechanisms extend through the one or more openings to engage the other of the downhole ramp or uphole ramp to thereby lock a relative axial position of the substantially circular downhole shoulder and the substantially circular uphole shoulder.

14. The well drilling system as recited in claim 13, wherein the one or more openings are one or more slots and the one or more locking mechanisms are one or more bolts, and further wherein the other of the downhole ramp or uphole ramp has one or more threaded openings therein configured to engage the one or more bolts extending through the one or more slots.

15. The well drilling system as recited in claim 12, wherein the downhole ramp angle and uphole ramp angle are substantially the same.

16. The well drilling system as recited in claim 15, wherein the downhole ramp angle and uphole ramp angle are less than about 15 degrees.

17. The well drilling system as recited in claim 11, wherein the substantially circular downhole shoulder and the substantially circular uphole shoulder are configured to move axially by up to about 30 mm relative to one another.

18. The well drilling system as recited in claim 10, wherein the lock ring is a threaded lock ring, and the two or more separate downhole pieces and two or more separate uphole pieces have corresponding lock ring threads, and further wherein one of the two or more separate downhole pieces or two or more separate uphole pieces rotate relative to the other of the two or more separate downhole pieces or two or more separate uphole pieces and the threaded lock ring, thereby moving the substantially circular downhole shoulder and the substantially circular uphole shoulder axially outward relative to one another.

* * * * *